US008381443B2

(12) United States Patent
Smith et al.

(10) Patent No.: US 8,381,443 B2
(45) Date of Patent: Feb. 26, 2013

(54) SLIDING DOOR

(76) Inventors: Brian Smith, Big Rock, IL (US); Jason P. Sabotta, Hinkley, IL (US)

( * ) Notice: Subject to any disclaimer, the term of this patent is extended or adjusted under 35 U.S.C. 154(b) by 0 days.

(21) Appl. No.: 13/420,319

(22) Filed: Mar. 14, 2012

(65) Prior Publication Data

US 2012/0255230 A1 Oct. 11, 2012

Related U.S. Application Data

(60) Provisional application No. 61/472,738, filed on Apr. 7, 2011.

(51) Int. Cl.
*E06B 3/50* (2006.01)
*E05D 15/56* (2006.01)

(52) U.S. Cl. ..... 49/141; 49/142; 49/125; 49/161

(58) Field of Classification Search ..... 49/121, 49/123–125, 141, 142, 161, 162, 164, 168, 49/188, 189, 323, 409, 410
See application file for complete search history.

(56) References Cited

U.S. PATENT DOCUMENTS

| | | | | |
|---|---|---|---|---|
| 704,887 A | | 7/1902 | Low | |
| 3,300,897 A | | 1/1967 | Wikkerink | |
| 3,318,047 A | | 5/1967 | Carson | |
| 3,354,581 A | | 11/1967 | Dimmitt et al. | |
| 3,466,805 A | | 9/1969 | Muessel | |
| 3,491,483 A | | 1/1970 | Miller | |
| 4,078,333 A | * | 3/1978 | Lussier | 49/141 |
| 4,305,227 A | | 12/1981 | Georgelin | |
| 4,438,594 A | | 3/1984 | Bunzl | |
| 4,503,637 A | | 3/1985 | Parente | |
| 4,534,395 A | * | 8/1985 | Carroll | 160/199 |
| 5,242,005 A | * | 9/1993 | Borgardt | 160/118 |
| 5,392,834 A | | 2/1995 | Borgardt | |

(Continued)

FOREIGN PATENT DOCUMENTS

| | | |
|---|---|---|
| JP | 09088441 A | 3/1997 |
| JP | 2009215822 | 9/2009 |

(Continued)

OTHER PUBLICATIONS

Horton Automatics "Profiler-ICUU Manual Sliding Door System" (It is my current belief that the products described in this brochure were not offered for sale prior to Apr. 7, 2011.).

(Continued)

*Primary Examiner* — Katherine W Mitchell
*Assistant Examiner* — Justin Rephann
(74) *Attorney, Agent, or Firm* — Hamilton IP Law, PC; Jay R. Hamilton; Charles A. Damschen

(57) ABSTRACT

A sliding door with a sliding panel and a fixed panel allows for the sliding panel to pivot with respect to the fixed panel regardless of the position of the sliding panel and allows both the sliding panel and fixed panel to pivot with respect to an outer frame in which the panels are mounted when the sliding panel is fully open or nearly fully open without requiring a floor track. The sliding panel may move linearly with respect to the fixed panel and outer frame along the length of a header, and a guide bracket cooperatively engaged with the sliding panel may be partially positioned in a guide track formed in the fixed panel bottom rail. A floor plate may be secured to the floor surface adjacent the bottom end of a first jamb to provide support/stability to the panels.

5 Claims, 13 Drawing Sheets

U.S. PATENT DOCUMENTS

| | | | | |
|---|---|---|---|---|
| 5,486,026 | A * | 1/1996 | Borgardt | 292/71 |
| 5,749,172 | A * | 5/1998 | Isopahkala | 49/127 |
| 5,762,123 | A * | 6/1998 | Kuyama et al. | 160/195 |
| 5,832,980 | A | 11/1998 | Cianciolo | |
| 5,893,181 | A | 4/1999 | Moncaster | |
| 6,058,665 | A * | 5/2000 | Halvorson et al. | 52/205 |
| 6,061,961 | A | 5/2000 | Rupe | |
| 6,170,195 | B1 | 1/2001 | Lim | |
| 6,276,092 | B1 * | 8/2001 | Neo | 49/183 |
| 6,422,287 | B1 | 7/2002 | Wilke | |
| 6,526,695 | B1 | 3/2003 | Nguyen | |
| 6,618,994 | B1 * | 9/2003 | Nussbaum | 49/180 |
| 6,973,753 | B2 | 12/2005 | Liebscher | |
| 7,117,637 | B2 | 10/2006 | Delgado et al. | |
| 7,222,457 | B2 | 5/2007 | Delgado et al. | |
| 7,296,608 | B2 | 11/2007 | Weishar et al. | |
| 7,451,802 | B2 | 11/2008 | Cianciolo et al. | |
| 7,458,410 | B1 * | 12/2008 | Bronner | 160/197 |
| 7,950,439 | B2 | 5/2011 | Anderson | |
| 8,096,342 | B2 * | 1/2012 | Scruggs | 160/211 |
| 2004/0025455 | A1 | 2/2004 | Nubel et al. | |
| 2004/0107642 | A1 | 6/2004 | Liebscher | |
| 2006/0101718 | A1 | 5/2006 | Fronz et al. | |
| 2006/0150512 | A1 | 7/2006 | Heithe et al. | |
| 2007/0144070 | A1 | 6/2007 | Delgado et al. | |
| 2007/0234641 | A1 | 10/2007 | Delgado et al. | |
| 2008/0250716 | A1 | 10/2008 | Ranaudo et al. | |
| 2012/0073205 | A1 | 3/2012 | Hamaker et al. | |

FOREIGN PATENT DOCUMENTS

| | | | |
|---|---|---|---|
| WO | WO 9946470 | A1 | 9/1999 |

OTHER PUBLICATIONS

Nabco Entrances Gyro Tech GT 2100 Manualslide Door (Document became known to Applicant on or around Sep. 22, 2011; Documents suggest date of publication of Aug. 2010.).

Assa Abloy "Manual Doors for ICU/CCU Rooms" (Document became known to Applicant on or around Sep. 22, 2011; Applicant is unable to confirm first date of publication or sale.).

ISR received by Applicant in co-pending PCT application having serical No. PCT/US2012/032766; to be published Oct. 9, 2012; submitted in its entirety.

* cited by examiner

SLIDING DOOR

CROSS REFERENCE TO RELATED APPLICATIONS

Applicant claims priority from U.S. Provisional Pat. App. No. 61/472,738 filed on Apr. 7, 2011, which is incorporated by reference herein in its entirety.

FIELD OF THE INVENTION

The present invention relates to a trackless sliding door with a break-away function.

STATEMENT REGARDING FEDERALLY SPONSORED RESEARCH OR DEVELOPMENT

No federal funds were used to create or develop the invention herein.

REFERENCE TO SEQUENCE LISTING, A TABLE, OR A COMPUTER PROGRAM LISTING COMPACT DISK APPENDIX

N/A

BACKGROUND OF THE INVENTION

Manual sliding doors with a break-away function are commonly used as entrances for Intensive Care (ICU) suites in hospitals and health care facilities. Doors of this type provide unobstructed vision of the patient for the care providers as well as privacy and sound reduction for the patient. While conventional models of manual sliding doors for this purpose provide a clear view of patients and privacy they have inherent problems.

Manual sliding doors of the subject type are available in two basic arrangements: (i) trackless sliding doors and (ii) tracked sliding doors. A trackless ICU-type manual sliding door of the subject type generally includes a header member having a top side, back side and bottom side along with an access service cover. The access service cover may be configured as either a removable cover or a hinged cover that is capable of being supported in both the open and closed positions. Also present within the header member is a top track for sliding door support rollers and stop blocks to prevent the sliding panels from sliding past the allowable or necessary distance. The door unit also includes one or more sliding panels and one or more fixed panels.

The sliding door panel and fixed panel will have the ability to break away in either the event of an emergency and the need to move equipment into the ICU suite. The sliding panel(s) are often outfitted with a type of torsion bar that will support the panel in the event of break away. The conventional construction of these types of doors is extruded aluminum members for the header and door stiles.

Conventional trackless manual sliding doors will not break away in any position. Instead, the sliding panel first must be slid fully open and then a release lever operated on the fixed panel. Once the sliding panel is fully open and the lever released, both doors may be swung out together as a unit. This action requires previous or special knowledge for proper performance. In an emergency situation, an operator may forget the sequence needed. Also, an individual with no knowledge of the door could not be expected to perform such an operation. Furthermore, the presence of the release lever, commonly known as a flush bolt, presents a maintenance and service issue. If the flush bolt is not fully released when the operator attempts to break away the panels, the guide bracket for the slide bolt portion of the flush bolt can easily be broken or misaligned. It is then possible when the guide is damaged or broken, that the fixed panel cannot be readily secured back into operating position. The lack of a breakaway feature that operates at any time during operation without special knowledge presents a problem in regards to life safety and egress.

Conventional tracked units, while able to break away in any position during the sliding panel's travel, require a floor mounted track. The presence of a track on the floor presents an obstacle that needs to be overcome when moving large equipment into an ICU suite. Furthermore the conventional floor track provides a recess for the sliding panel bottom guide pin. This recess is difficult to keep clean and clear of debris. In an environment such as an ICU wing, infectious control is a major concern. The floor track could harbor dirt, bacteria, and/or pathogens making it more difficult to maintain a clean working environment. Accordingly, the sliding doors as found in the prior art present several problems.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limited of its scope, the invention will be described and explained with additional specificity and detail through the use of the accompanying drawings.

DETAILED DESCRIPTION

Element Listing

Figure 1:
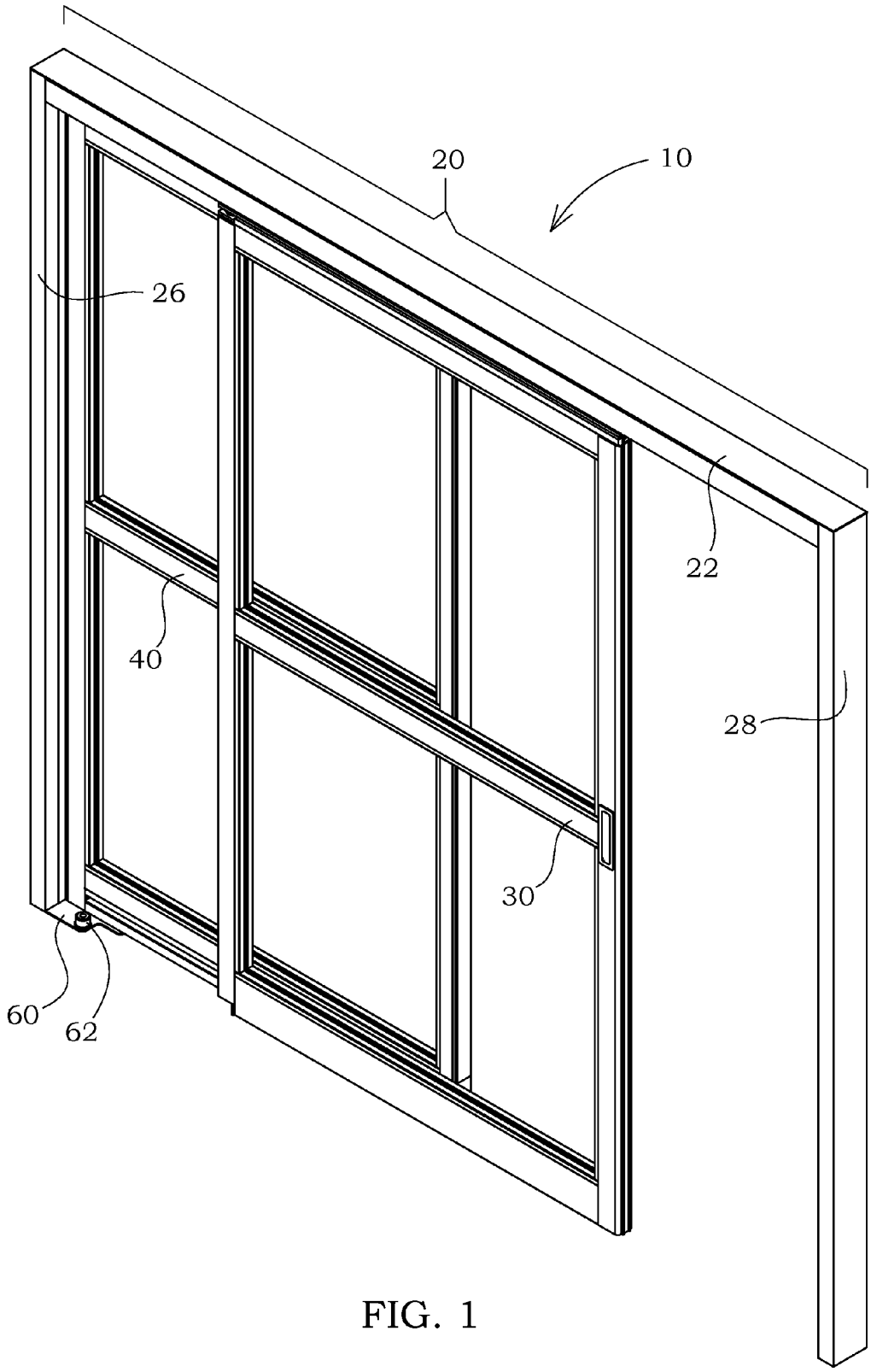
FIG. 1 is a perspective view of a first embodiment of the sliding door with the sliding panel partially open.

| Description | Element No. |
|---|---|
| Sliding door | 10 |
| Lock member | 12 |
| Pane groove | 14 |
| Pane | 16 |
| Outer frame | 20 |
| Header | 22 |
| Sliding track | 22a |
| Stop block | 23 |
| Fixed panel guide | 24 |
| Guide interlock | 24a |
| Guide detent | 24b |
| Fixed panel pivot pin | 25 |
| First jamb | 26 |
| Second jamb | 28 |
| Sliding panel | 30 |
| Sliding panel first vertical rail | 31a |
| Sliding panel second vertical rail | 31b |
| Sliding panel top rail | 32 |
| Sliding panel interlock | 32a |
| Sliding panel bottom rail | 34 |
| Guide block | 35 |
| Guide bracket | 36 |
| Bracket base | 37 |
| Guide pin | 38 |
| Pivot pin | 39 |
| Fixed panel | 40 |
| Fixed panel first vertical rail | 41a |
| Fixed panel second vertical rail | 41b |
| Fixed panel top rail | 42 |
| Fixed panel interlock | 42a |
| Fixed panel bottom rail | 44 |
| Guide track | 44a |
| Carrier bar | 50 |
| Carrier bar interlock | 52 |
| Carrier bar detent | 52a |
| Roller | 53 |
| Sliding panel pivot pin | 54 |
| Floor plate | 60 |
| Panel bearing | 62 |
| Fixed panel post | 64 |

DETAILED DESCRIPTION

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

While the invention is susceptible of various modifications and alternative constructions, a certain embodiment is shown in the drawings and described in detail below. It should be understood, however, that there is no intention to limit the invention to the specific form disclosed, but on the contrary, the intention is to cover all modifications, alternative constructions and methods, and equivalents falling within the spirit and scope of the invention.

Figure 2:
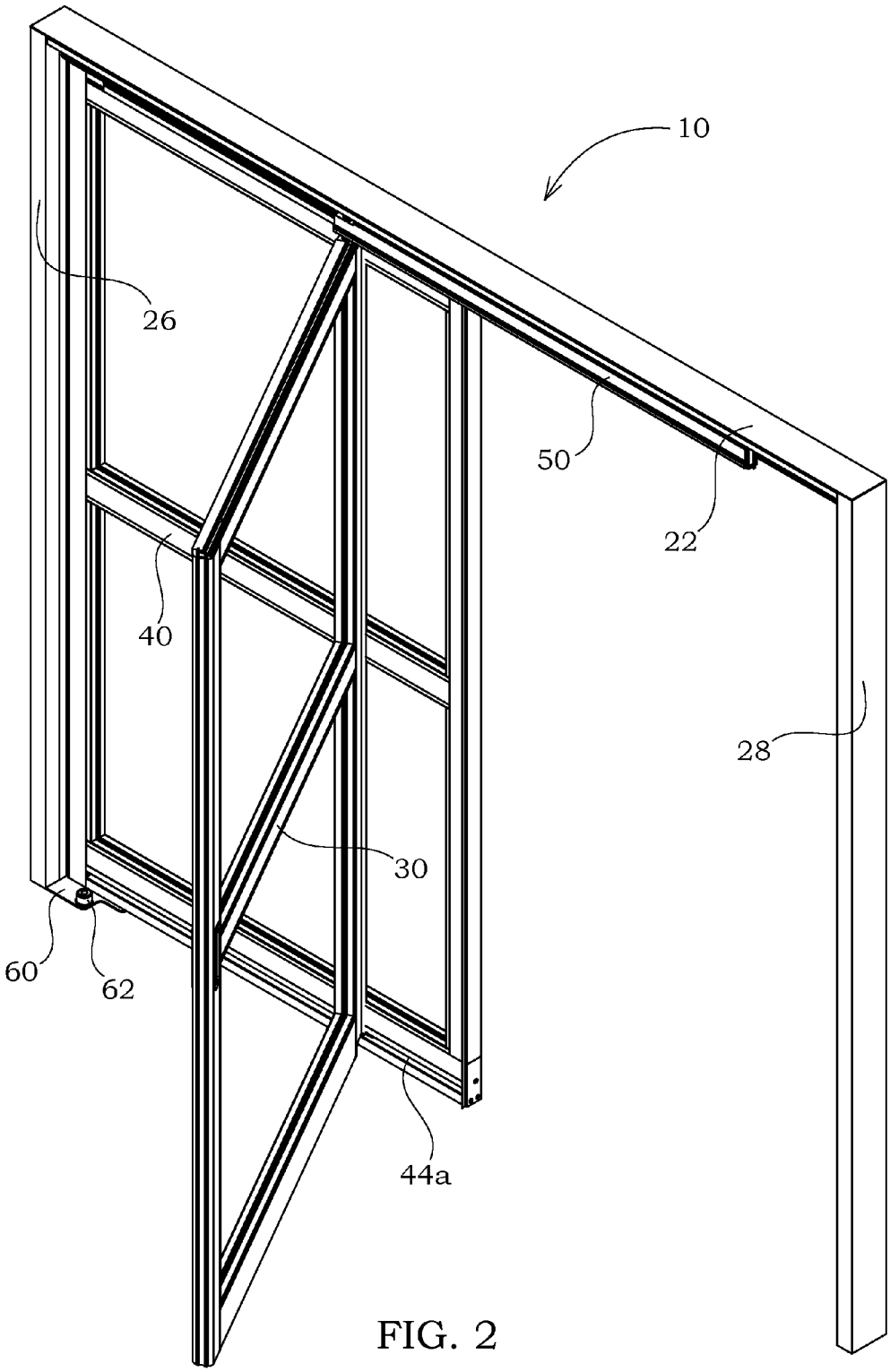
FIG. 2 is a perspective view of the first embodiment of the sliding door with the sliding panel partially open and broken away from the fixed panel.
Figure 3:
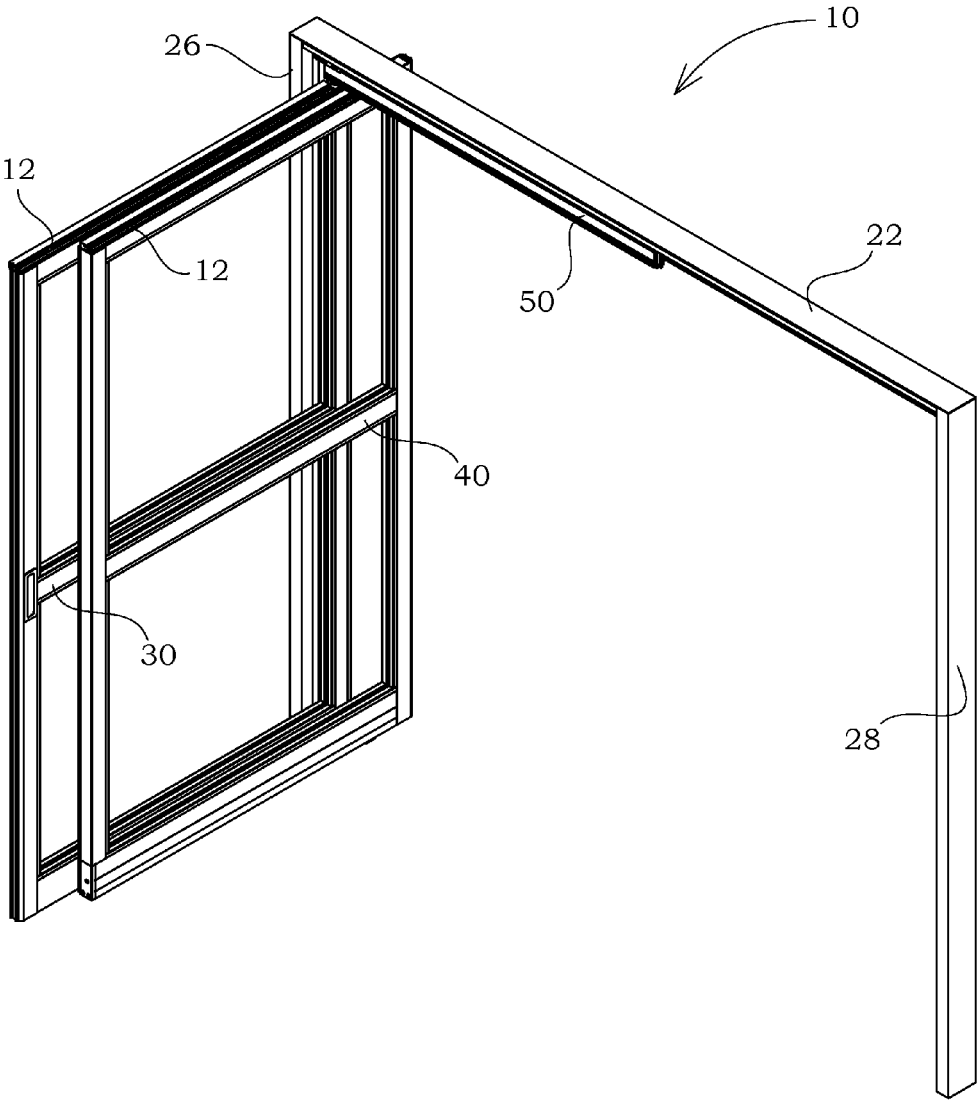
FIG. 3 is a perspective view of the first embodiment of the sliding door with the sliding panel in the fully open position with both the sliding panel and the fixed panel broken away from the outer frame.

As shown in the drawings, a sliding door 10 according to the present disclosure may include at least one sliding panel 30 and at least one fixed panel 40 cooperatively engaged with an outer frame 20. The sliding panel 30 is configured so that it may move along a header 22 and slide next to the fixed panel 40 in linear plane that is parallel to but offset from the fixed panel 40. The sliding door 10 is configured so that the edge of the sliding panel 30 adjacent the sliding panel second vertical rail 31*b* may break away from the outer frame 20 when the sliding panel 30 is any position relative to the outer frame 20 or fixed panel 40 (e.g., fully open, fully closed, partially open). Additionally, an edge of the fixed panel 40 adjacent the fixed panel first vertical rail 41*a* may break away from the outer frame 20 when the sliding panel 30 is fully open or nearly fully open. No floor track is required to accommodate the sliding panel 30 or fixed panel 40 breaking away from the outer frame 20. FIG. 1 shows the first embodiment of the sliding door 10 wherein the sliding panel 30 is partially open, and FIG. 2 shows the sliding panel 30 with the edge thereof adjacent the sliding panel second vertical rail 31*b* broken away from the outer frame 20. FIG. 3 shows both the sliding panel 30 and fixed panel 40 broken away from the outer frame 20. Each panel 30, 40 may generally be formed as a rectangle. The sliding panel 30 may include a sliding panel first and second vertical rail 31*a*, 31*b* and a sliding panel top and bottom rail 32, 34. The fixed panel 40 may include a fixed panel first and second vertical rail 41*a*, 41*b* and a fixed panel top and bottom rail 42, 44.

The embodiment of an outer frame 20 as disclosed herein generally includes a header 22 abutting first and second jambs 26, 28 at either end of the header 22. It is contemplated that the jambs 26, 28 may be of the type used in conventional sliding doors, but the sliding door 10 as disclosed and claimed herein is not so limited, and any suitable structure and/or method for engaging the sides of the sliding panel 30 and/or fixed panel 40 may be used without limitation.

Figure 4:
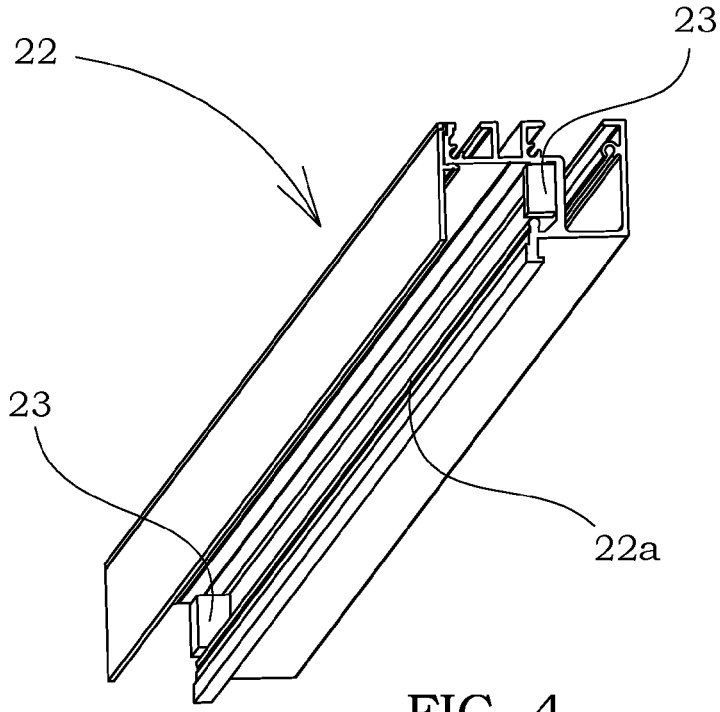
FIG. 4 is a detailed view of one embodiment of a header that may be used with certain embodiments of the sliding door.

FIG. 4 provides a detailed view of one embodiment of a header 22 that may be used with the illustrative embodiment of a sliding door 10. This embodiment of a header 22 may be formed with a sliding track 22*a* therein to accommodate a carrier bar 50, as described in detail below. The sliding track 22*a* generally may extend along the entire length of the header 22 and allow the carrier bar 50 to slide laterally along the length of the header 22. The header 22 may also be formed with a stop block 23 at either end of the sliding track 22*a* adjacent the fixed panel first and second vertical rails 41*a*, 41*b* to limit the distance of travel for the sliding panel 30. The header 22 may also be formed with a fixed panel guide 24 along a portion thereof for selective engagement with the fixed panel top rail 42. The fixed panel guide 24 may include a guide interlock 24*a* protruding from the fixed panel guide 24, which guide interlock 24*a* corresponds to a fixed panel interlock 42*a* formed in the fixed panel top rail 42. The fixed panel guide 24 may also include a guide detent 24*b* for selective engagement with a lock member 12 positioned in the fixed panel top rail 42. The fixed panel 40 may pivot with respect to the outer frame 20 (e.g., when the fixed panel 40 is broken away from the outer frame 20) about a fixed panel pivot pin 25.

Figure 5A:
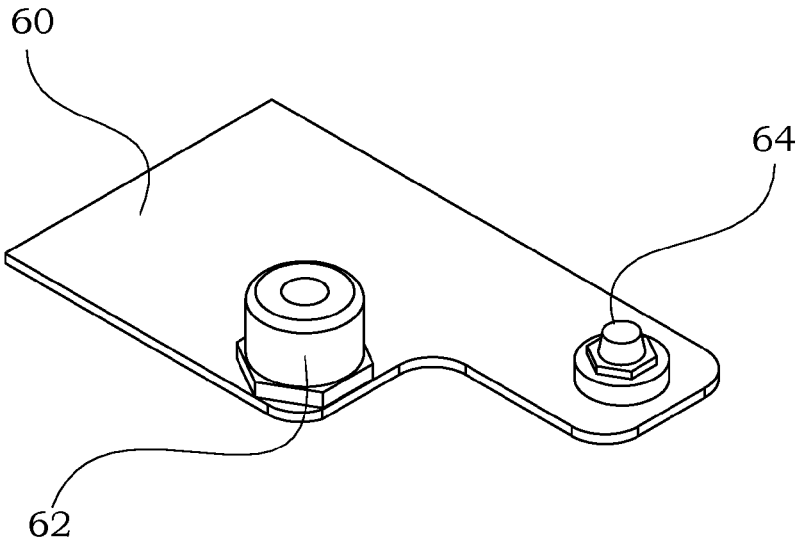
FIG. 5A is a detailed view of one embodiment of a floor plate that may be used with certain embodiments of the sliding door.
Figure 5B:
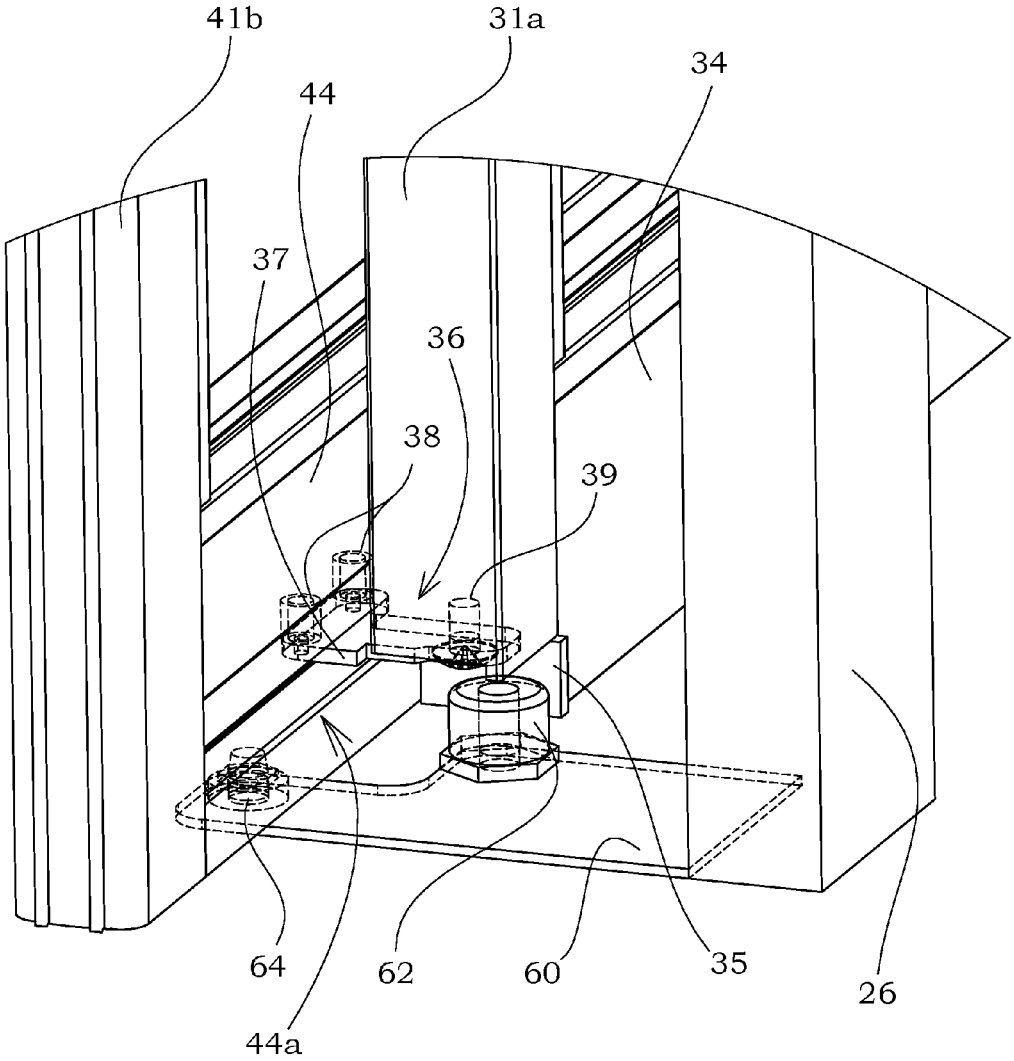
FIG. 5B is a detailed view of the embodiment of the floor plate shown in FIG. 5A with the sliding and fixed panels installed.

FIGS. 5A & 5B show one embodiment of a floor plate 60 that may be used with the illustrative embodiment of the sliding door 10. It is contemplated that the floor plate 60 will be secured to the floor/bottom surface to which the lower ends of the jambs 26, 28 extend, but other configurations may be used without limitation. It is also contemplated that the floor plate 60 may be sized to not be exposed when both panels 30, 40 are broken way. Configuring the floor plate 60 so that it is located beneath both panels 30, 40 protects the floor plate 60 from damage. The floor plate 60 may include a fixed panel post 64 that pivotally engages the fixed panel bottom rail 44. Accordingly, when the fixed panel 40 is broken away from the outer frame 20, the fixed panel 40 is engaged with the outer frame 20 solely through the fixed panel pivot pin 25 adjacent the fixed panel top rail 42 and the fixed panel post 64 adjacent the fixed panel bottom rail 44. The floor plate 60 also may include a panel bearing 62 positioned between the fixed panel post 64 and the first jamb 26. The panel bearing 62 may selectively engage the sliding panel bottom rail 34 to prevent damage to any components of the sliding door 10. That is, when the sliding panel 30 and fixed panel 40 are broke away together (as shown in FIG. 3), the panel bearing 62 may be configured to accept the transfer of the load from the sliding panel 30 and ensure that the sliding panel 30 remains straight and plumb in such circumstances.

Figure 6:
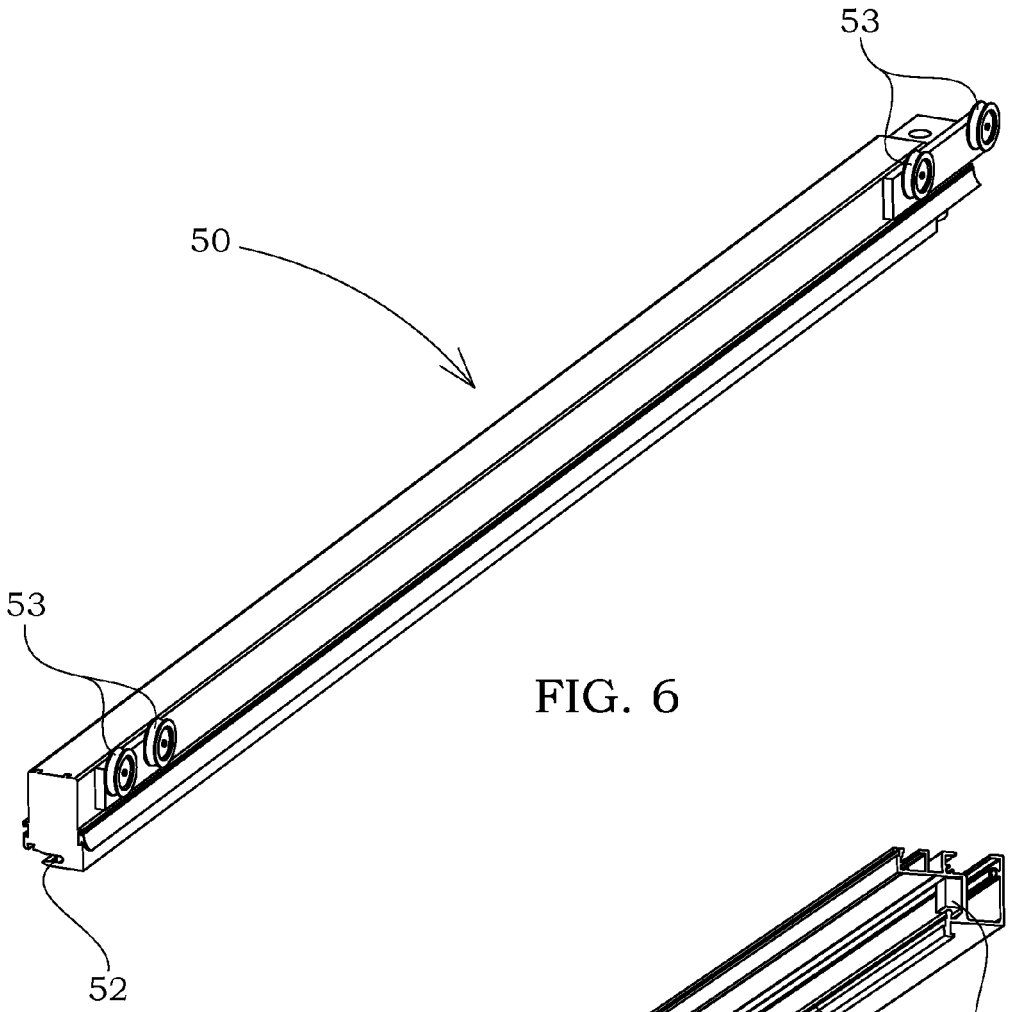
FIG. 6 is a detailed view of one embodiment of a carrier bar.
Figure 7:
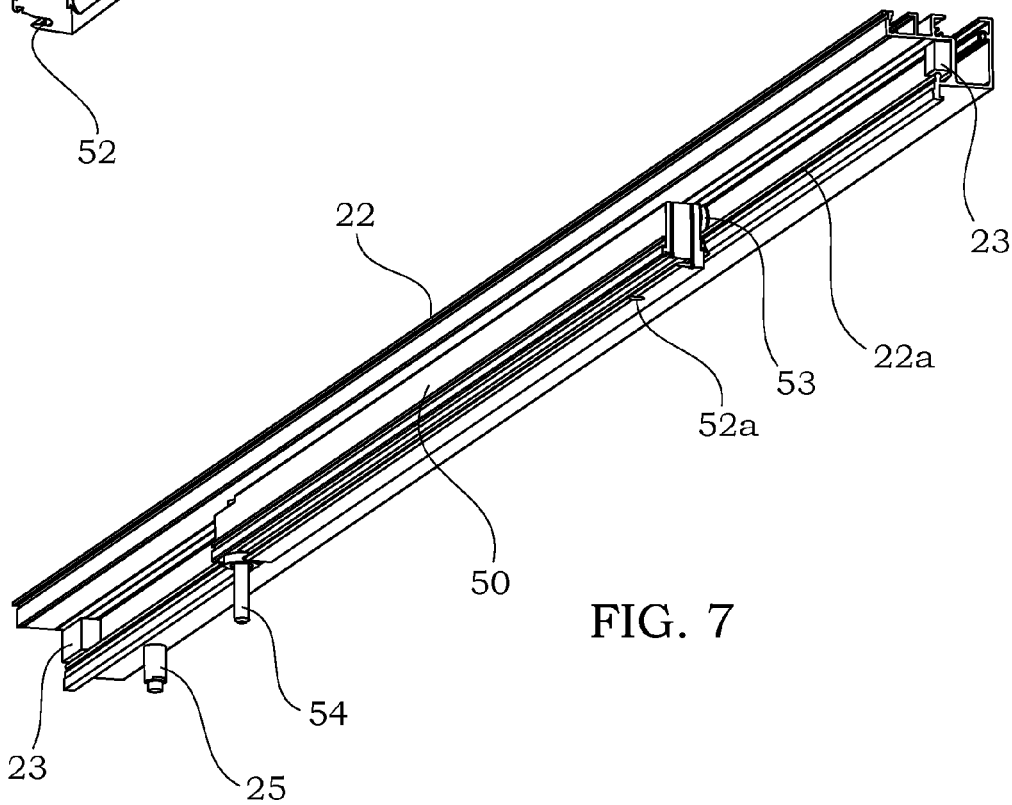
FIG. 7 is a detailed view of the embodiment of the carrier bar shown in FIG. 6 engaged with the embodiment of a header shown in FIG. 4 with an outer plate removed for clarity.

One embodiment of a carrier bar 50 that may be used with the illustrative embodiment of the sliding door 10 is shown in FIG. 6. For the illustrative embodiment of the sliding door 10, the carrier bar 50 generally supports the majority of the weight of the sliding panel 30 and facilitates linear movement of the sliding panel 30 with respect to the outer frame 20 and fixed panel 40. The carrier bar 50 is generally positioned within the sliding track 22*a* of the header 22 during use, as best shown in FIG. 7. This embodiment of a carrier bar 50 includes two pairs of rollers 53 at either end thereof, which rollers 53 are rotatable with respect to the carrier bar 50 and generally facilitate movement of the carrier bar 50 from one end of the header 22 to the other along the sliding track 22*a*. The carrier bar 50 may be formed with a carrier bar interlock 52 extending therefrom, which corresponds to a sliding panel interlock 32*a* formed in the sliding panel top rail 32. The carrier bar 50 may also include a carrier bar detent 52*a* for selective engagement with a lock member 12 positioned in the sliding panel top rail 32. The carrier bar 50 also may include a sliding panel pivot pin 54 for pivotal engagement with respect to the sliding panel top rail 32 (e.g., when the sliding panel 30 is broken away from the outer frame 20 and/or fixed panel 40).

Figure 8A:
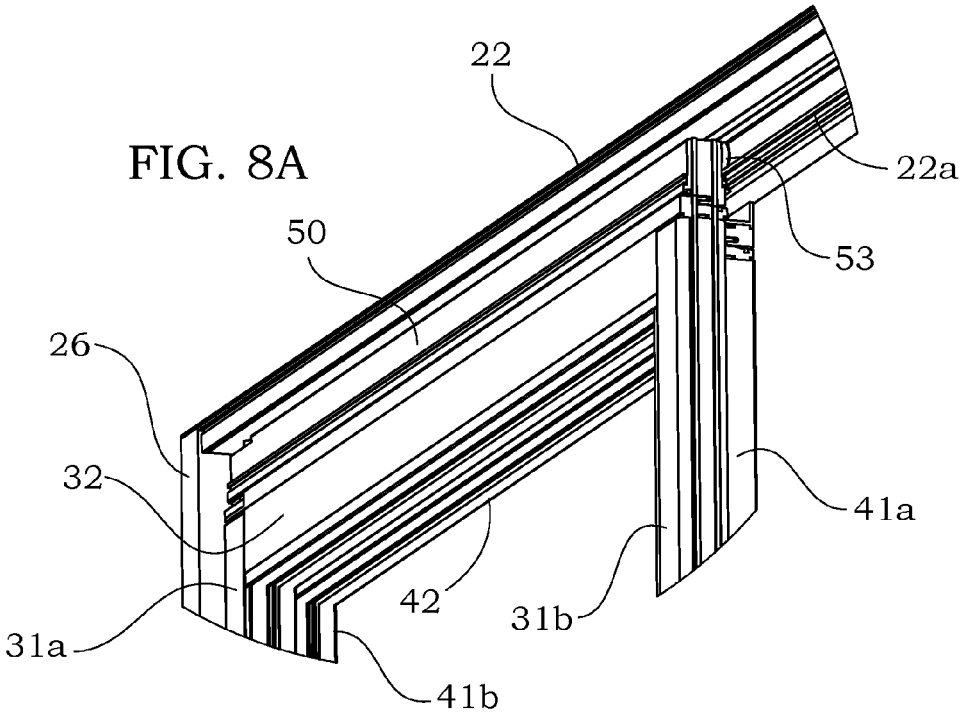
FIGS. 8A & 8B are detailed views of a sliding panel and fixed panel engaged with the embodiment of a header shown in FIG. 4 with the panels in the regular and broke away positions, respectively.
Figure 8B:
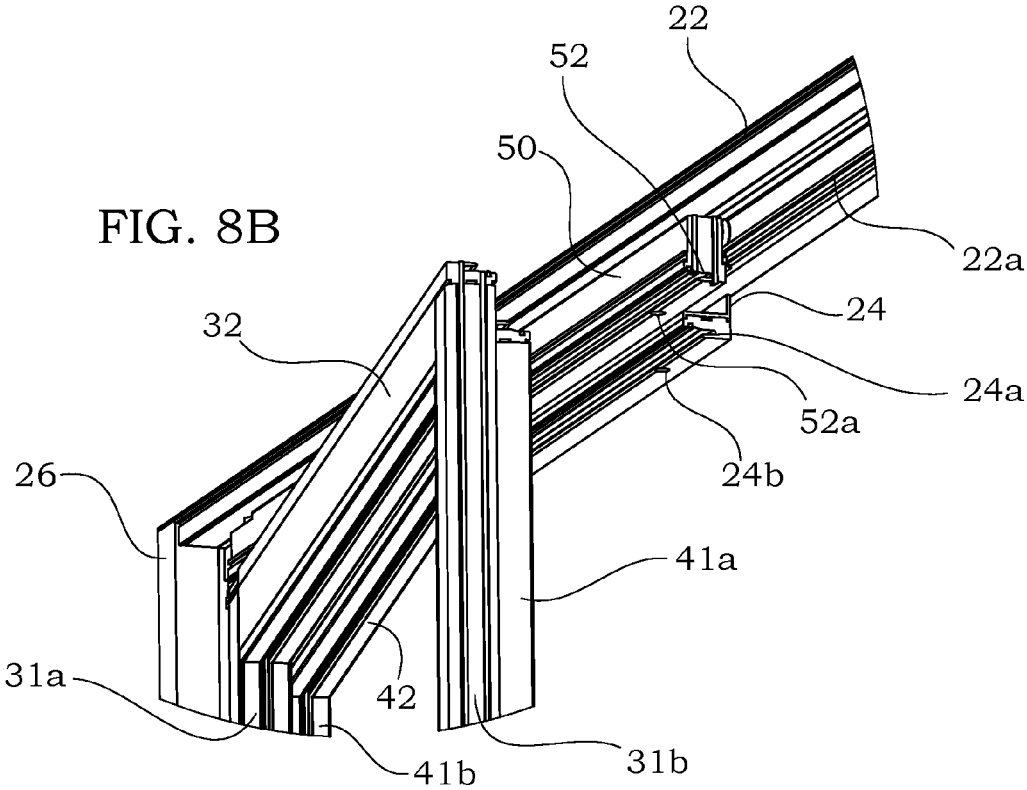
Figure 8C:
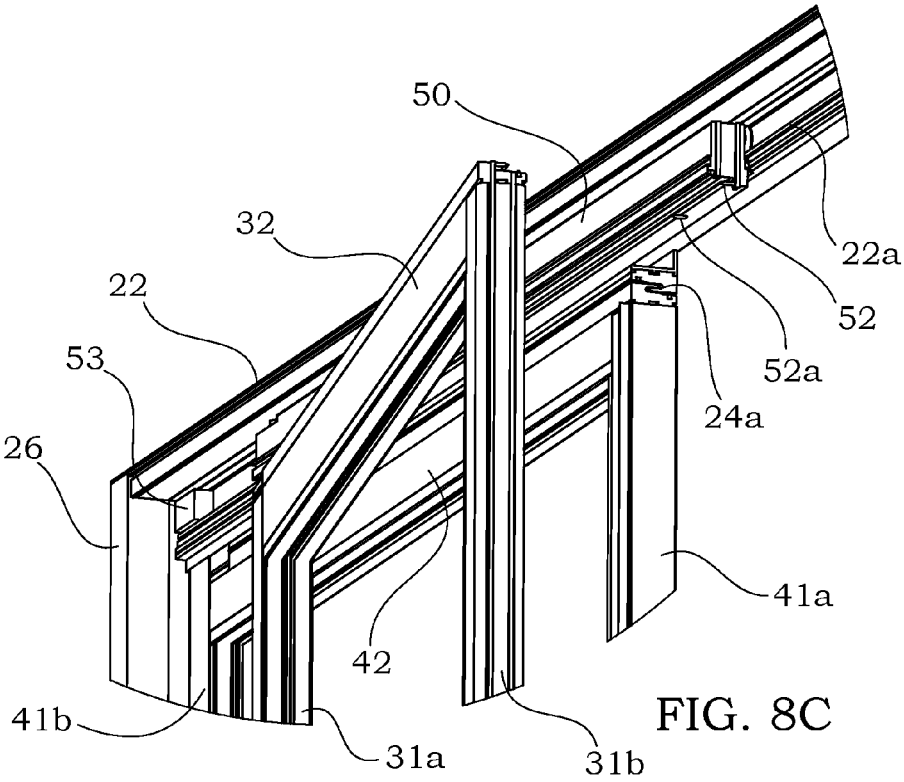
FIG. 8C is a detailed view of a sliding panel and fixed panel engaged with the embodiment of a header shown in FIG. 4 with the sliding panel in the broken away position.

FIGS. 8A & 8B provide views of the illustrative embodiments of the sliding panel 30 and fixed panel 40 engaged with the illustrative embodiment of a header 22 in the regular and broken away positions, respectively. FIG. 8C provides a view of only the sliding panel 30 in the broken away position. The illustrative embodiment of the sliding door 10 as disclosed herein is configured with lock members 12 formed as spring-loaded balls mounted in the sliding panel top rail 32 and fixed panel top rail 42, respectively. Each ball engages its respective detent 52*a*, 24*b* when the panels 30, 40 are in the regular position (i.e., parallel with respect to the header 22). The lock members 12 are designed so that a specific amount of force applied in a direction perpendicular to the length of the header 22 (preferably in the direction of egress) dislodges the ball from the respective detents 52*a*, 24*b*, thereby allowing the respective panel 30, 40 to break away (i.e., pivot outward) from the outer frame 20. Accordingly, the sliding door 10 does not an operator to have special knowledge of how the sliding door 10 works for the operator to easily and effectively break away either panel 30, 40. Furthermore, a ball detent-type lock member 12 as disclosed in the illustrative embodiment requires less maintenance, service, and/or repairs as compared to lever-actuated flush bolt mechanisms of prior art sliding doors.

Other structures and/or methods for selectively securing the orientation of the panels 30, 40 with respect to the header 22 with a predetermined amount of force may be used with the sliding door 10 as disclosed and claimed herein without limitation. For example, in another embodiment of the sliding door 10 not pictured herein, the lock member 12 may be formed as a sacrificial plastic dowel (rather than a spring-loaded ball), which must be replaced after the corresponding panel 30, 40 has broken away from the outer frame 20. Accordingly, the sliding door 10 is not limited to a lock member 12 and detents 52*a*, 24*b*, which are for illustrative purposes only.

Figure 8D:
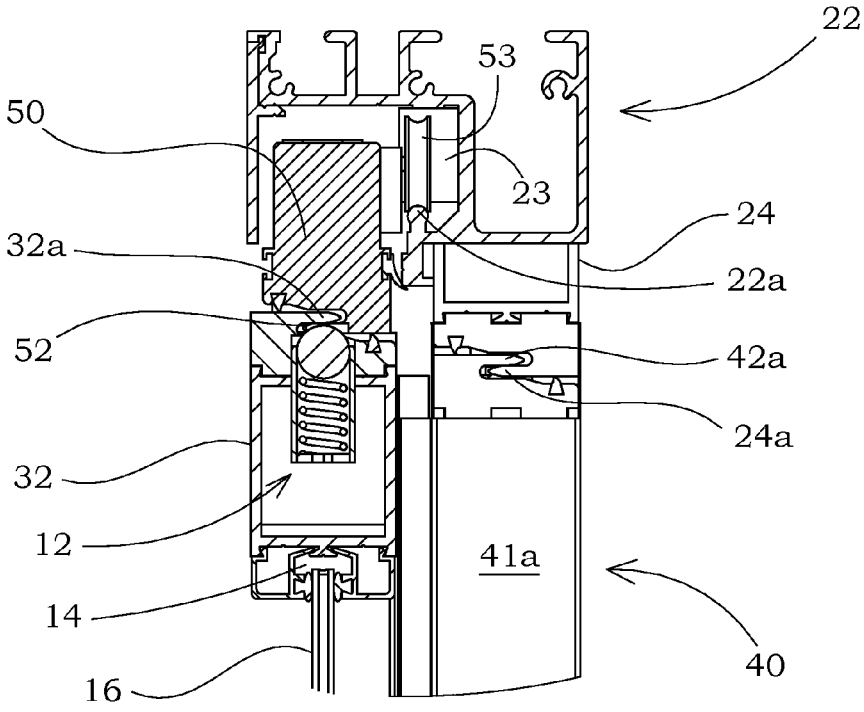
FIG. 8D is a cross-sectional view of the embodiment of the sliding and fixed panels, header, and carrier bar shown in FIGS. 8A & 8B about the lock member in the sliding panel top rail.

FIG. 8D provides a cross-sectional view of the illustrative embodiments of the header 22, panels 30, 40, and carrier bar 50 when both panels 30, 40 are in the regular position. As shown, the guide interlock 24*a* engages the fixed panel interlock 42*a*, the carrier bar interlock 52 engages the sliding panel interlock 32*a*, and the lock members 12 mounted in the sliding panel top rail 32 and fixed panel top rail 42 engage the carrier bar detent 52*a* and guide detent 24*b*, respectively, with the panels 30, 40 in this position.

Figure 9A:
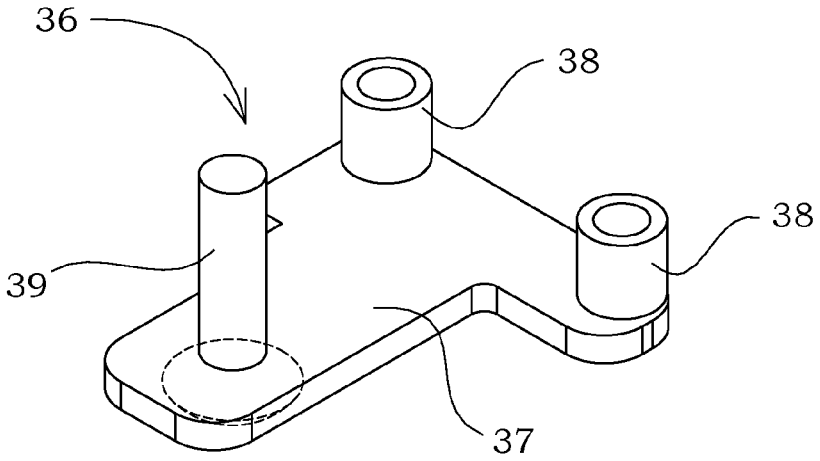
FIG. 9A is a perspective view of one embodiment of a guide bracket for use with a sliding panel.
Figure 9B:
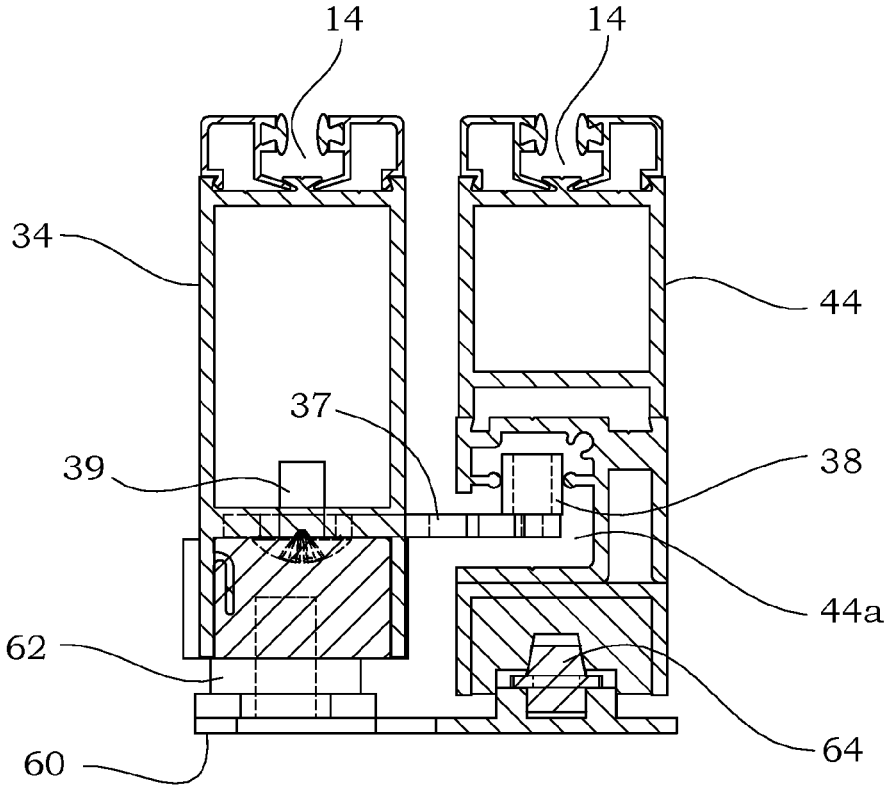
FIG. 9B is a cross-sectional view of the embodiment of a guide bracket shown in FIG. 9A engaged with one embodiment of a fixed panel bottom rail about the fixed panel post.
Figure 9C:
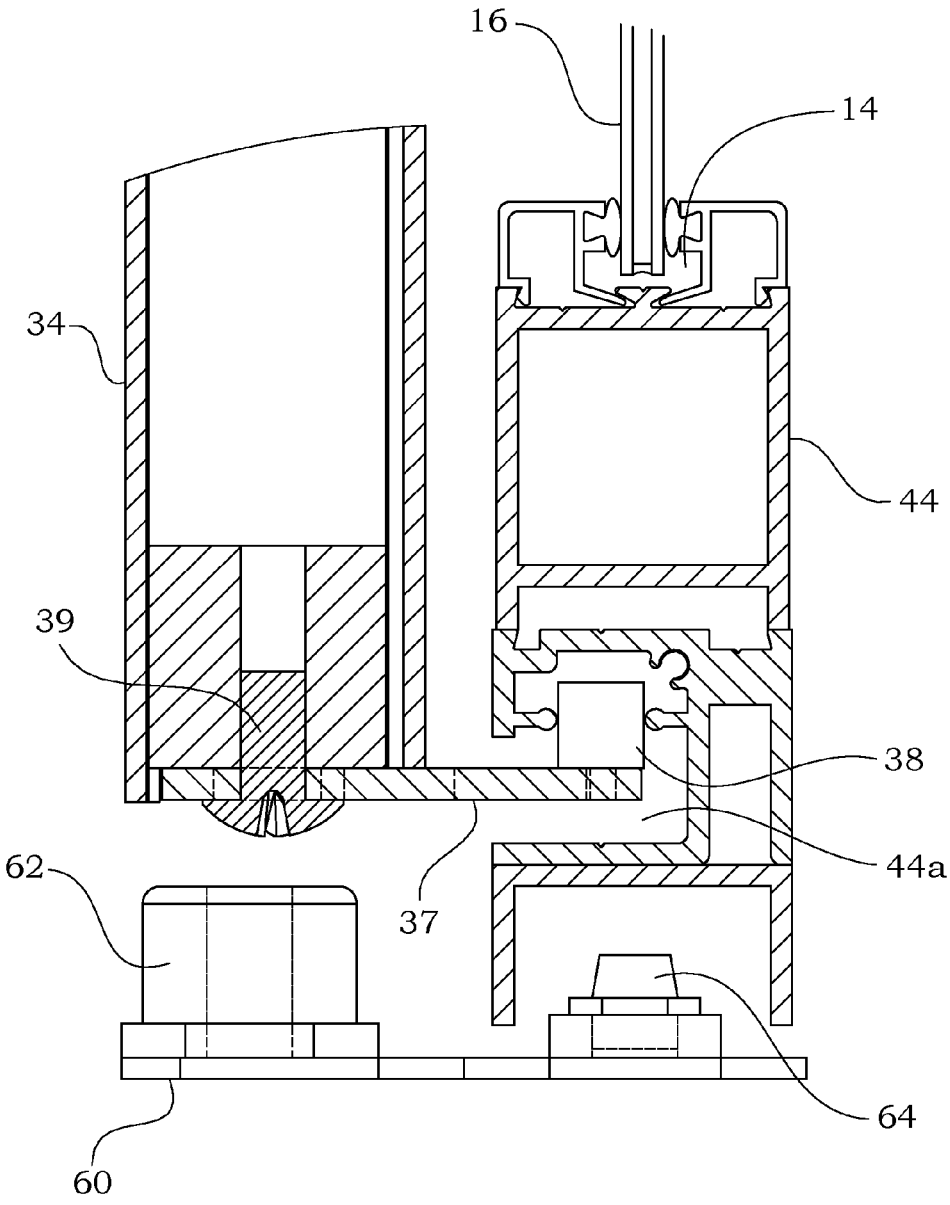
FIG. 9C is a cross-sectional view of the embodiment of a guide bracket shown in FIG. 9A engaged with one embodiment of a fixed panel bottom rail about the pivot pin.
Figure 10A:
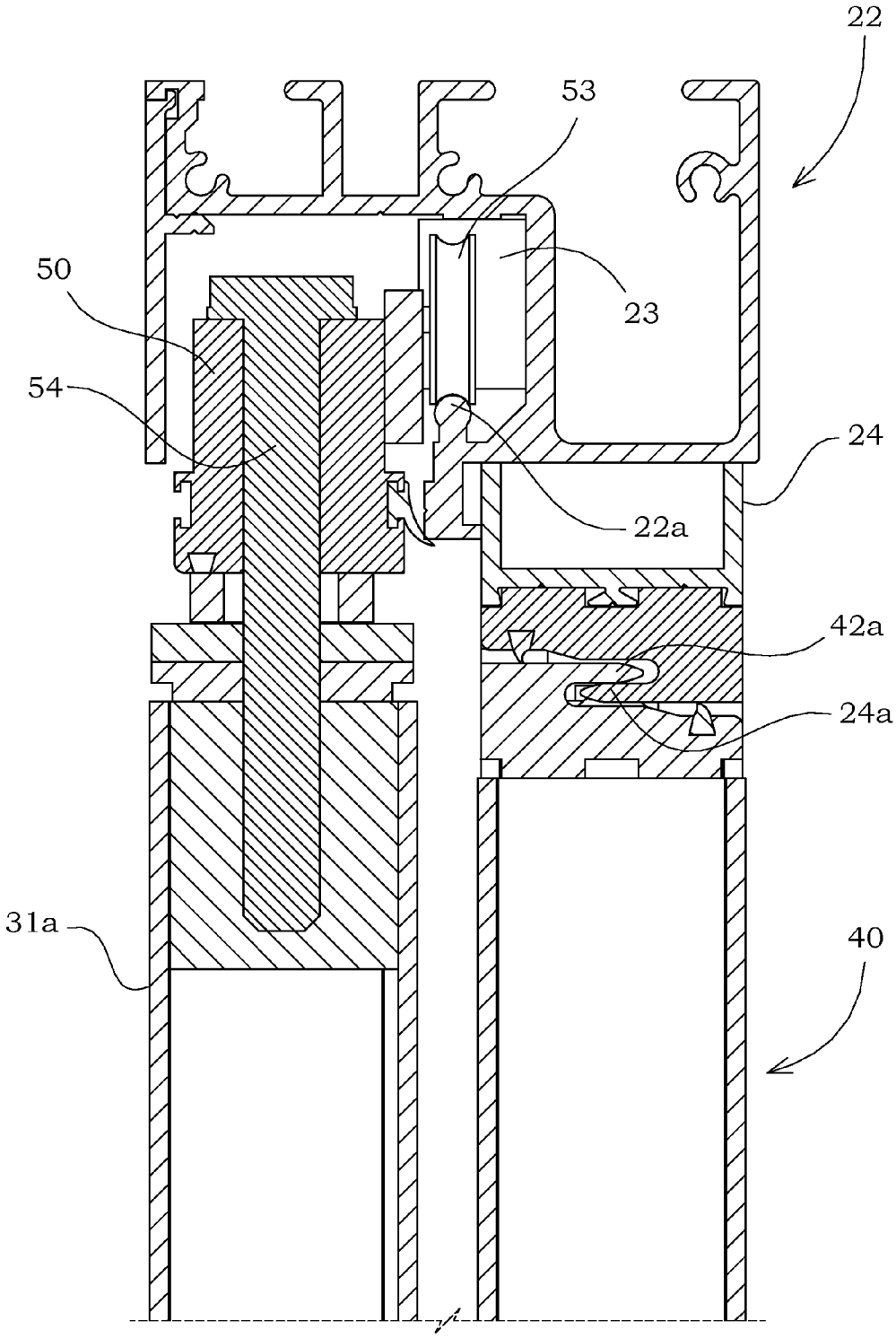
FIG. 10A is a cross-sectional view of a top portion of the first embodiment of the sliding door about the sliding panel pivot pin.
Figure 10B:
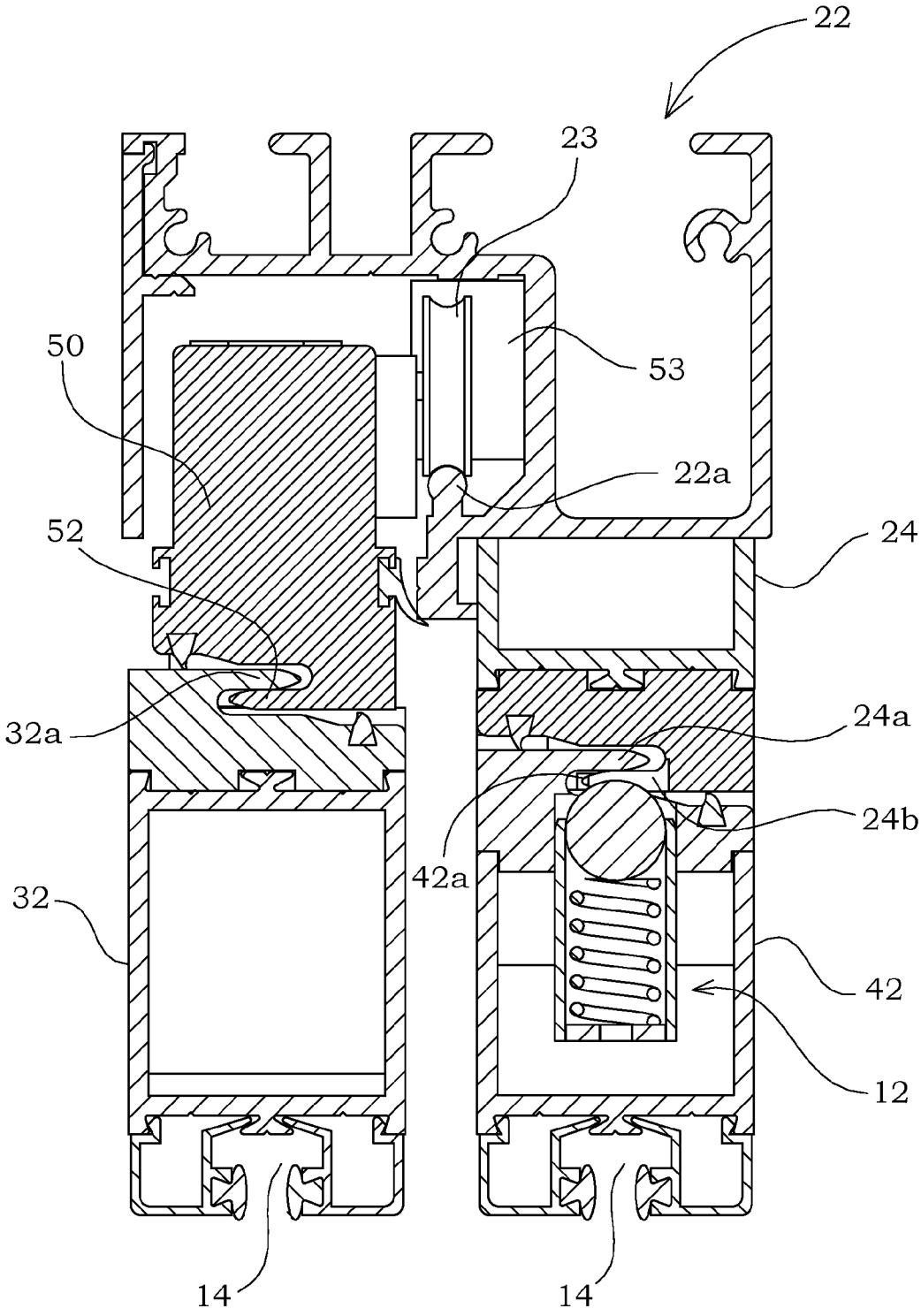
FIG. 10B is a cross-sectional view of a top portion of the first embodiment of the sliding door about the lock member in the sliding panel.
Figure 10C:
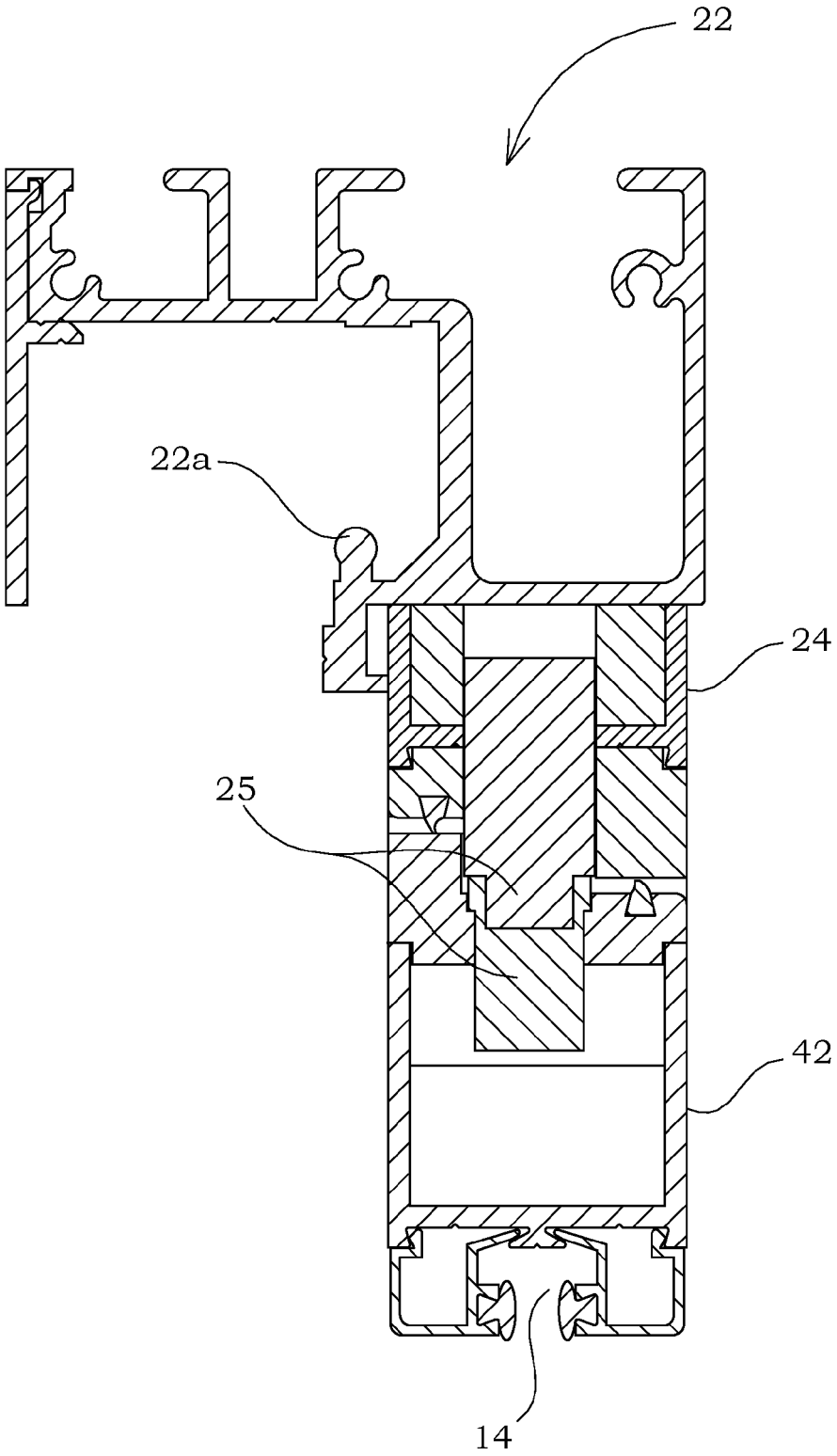
FIG. 10C is a cross-sectional view of the top portion of the first embodiment of the sliding door shown in FIGS. 10A & 10B about the fixed panel pivot pin.

A guide bracket 36 as shown in FIGS. 9A-9C may be pivotally mounted to the sliding panel bottom rail 34 on the end of the sliding panel bottom rail 34 adjacent the sliding panel first vertical rail 31*a*. The guide bracket 36 may be formed with a pivot pin 39 extending upward from the bracket base 37 that may pivotally engage the sliding panel bottom rail 34 and one or more guide pins 38 that may pivotally engaged the fixed panel bottom rail 44 at a guide track 44*a* formed therein. In the illustrative embodiment of the sliding door 10, when the sliding panel 30 breaks away from the fixed panel 40, the sliding panel 30 pivots with respect to the fixed panel 40 about the pivot pin 39 at the sliding panel bottom rail 34 and the sliding panel pivot pin 54 at the sliding panel top rail 32. Because the majority of the weight of the sliding panel 30 is supported on the carrier bar 50, the guide bracket 36 serves mainly to properly orient the sliding panel 30 with respect to the fixed panel 40 adjacent the sliding panel first vertical rail 31*a*. However, in other embodiments of the sliding door 10 the guide bracket 36 may be designed to support more weight and/or forces from the sliding panel 30 without limitation.

In light of the preceding description, the operation of the illustrative embodiment of the sliding door 10 should be apparent to those skilled in the art. The sliding panel 30 may pivotally engage a carrier bar 50 via a sliding panel pivot pin 54, and the sliding panel 30 may pivotally engage a fixed panel 40 via a pivot pin 39 formed in a guide bracket 36. The sliding panel 30 in the illustrative embodiment of the sliding door 10 moves linearly along the header 22 via the rollers 53 rotatably secured to the carrier bar 50 adjacent the sliding panel top rail 32 and via the engagement of the guide bracket 36 and guide track 44*a* adjacent the sliding panel bottom rail 34 such that the sliding door 10 is straight and plumb during operation. The fixed panel 40 of the illustrative embodiment of the sliding door 10 may pivotally engage a header 22 via a fixed panel pivot pin 25 adjacent the fixed panel top rail 42 and may pivotally engage a floor surface via a fixed panel post 64 formed in a floor plate 60 (which floor plate 60 may be affixed to the floor surface) adjacent the fixed panel bottom rail 44.

The guide interlock 24*a* may engage a fixed panel interlock 42*a* to ensure proper alignment of the fixed panel 40 with respect to the outer frame 20 when the sliding door 10 is in the normal position. A carrier bar interlock may engage a sliding panel interlock 32*a* to ensure proper alignment of the sliding panel 30 with respect to the fixed panel 40 and outer frame 20 when the sliding door 10 is in the normal position. The various interlocks 24*a*, 42*a*, 32*a*, 52 may be formed to require a predetermined amount of force to become disengaged with the corresponding interlock 24*a*, 42*a*, 32*a*, 52. Accordingly, in certain embodiments of the sliding door 10, detents 24*b* and 52*a* and corresponding lock members 12 may not be required. Instead, the corresponding interlocks 24*a*, 42*a*, 32*a*, 52 may be configured with complimentary lips (not shown) and/or other latch mechanisms that properly secure the respective interlocks 24*a*, 42*a*, 32*a*, 52 with one another unless acted upon by an outside force sufficient to break away the sliding panel 30 and/or fixed panel 40.

It is contemplated that for most applications it will be desirable to construct the panels 30, 40, outer frame 20, and carrier bar 50 of extruded aluminum, and that it will be desirable to construct the floor plate 60 from stainless steel.

It is contemplated that a prior art sliding door may be retrofit with specific components so that it may function as a sliding door 10 according to the illustrative embodiment pictured herein. As an example, the following describes modifications to a standard Horton Automatics brand sliding door to incorporate the functionality of present sliding door 10. The sliding panel first vertical rail 31*a* must be trimmed away from the sliding panel bottom rail 34 to allow the guide bracket 36 to move upward with respect to the floor surface. By moving the guide bracket 36 upward, it will now align with the guide track 44*a* formed in the fixed panel bottom rail 44.

It is contemplated that the guide bracket 36 will be manufactured specific to the modified design, and will vary depending on the type of prior art sliding door to be modified. This is necessary due to the unique nature of the specific models of prior art sliding doors. Also manufactured specifically depending on the model of prior art sliding door is a guide block 35 as best shown in FIG. 5B. The guide block 35 may be secured to the bottom surface of the sliding panel bottom rail 32. The guide block 35 ensures that the sliding panel 30 maintains a minimum clearance above the floor when both panels 30, 40 are broken away (as in FIG. 5B). The guide block 35 may serve to effectively transfer the weight of the sliding panel 30 to a pivot point located on the floor plate 60 adjacent the panel bearing 62. The guide block 35 and panel bearing 62 may carry the sliding panel 30 when the guide track 44*a* within the fixed panel bottom rail 44 is moved out of standard operating position (i.e., broken away). That is, a portion of the guide block 35 may engage the periphery of the panel bearing 62, which engagement ensures the sliding panel 30 remains straight and plumb as it is rotated about the axis of the sliding panel pivot pin 54 even if the fixed panel 40 is also broken away. Accordingly, it is contemplated that in the illustrative embodiment of the sliding door 10 the axis of rotation for the panel bearing 62 will be the same as that of the sliding panel pivot pin 54. Certain embodiments of the sliding door 10 (e.g., most that are not a retrofit of a prior art sliding door) will not require a guide block 35, as the sliding panel bottom rail 32 may be configured with a load-bearing portion adjacent the sliding panel first vertical rail 31*a* integral to the sliding panel bottom rail 32.

The fixed panel 40 for this model of prior art sliding door will require significant modification to perform as a fixed panel 40 according to the present sliding door 10. The overall height of the fixed panel 40 must be reduced to allow for the guide track 44*a* in the fixed panel bottom rail 44 and the guide interlock 24*a*, fixed panel interlock 42*a*, and fixed panel pivot pin 25 to facilitate the break away function of the fixed panel 40.

Either the fixed panel second vertical rail 41*b* or the first jamb 26 may be changed to a radius nosed type rail (preferably having full length weather striping installed along the entire height of the fixed panel 40). This will allow the fixed panel 40 to maintain a proper seal between the first jamb 26 and the fixed panel second vertical rail 41*b*, as well as provide necessary clearances for the break away function.

The fixed panel guide 24 formed in the header 22 and the fixed panel pivot pin 25 may interact with the fixed panel top rail 42 to form a scissor-type design, which allows for maximum support for the fixed panel 40 in the standard operating position, and adequate support during break away situations.

The fixed panel bottom rail 44 may be cut down so that it has a smaller height and relocated upward on the fixed panel first and second vertical rails 41*a*, 41*b*. The guide track 44*a* may then be secured to the fixed panel bottom rail 44. A u-channel member (not shown) may then be added to the fixed panel bottom rail 44 to complete the modification. This u-channel may be configured to provide for a mounting location for the fixed panel post 64 of the floor plate 60 if not present in the guide track 44*a* as well as providing the proper overall panel height for the fixed panel 40.

The floor plate 60 may be specifically constructed for the model of prior art sliding door that is converted to a sliding door 10 according to the present disclosure. It is contemplated that at least the specific orientation of the panel bearing 62 and fixed panel post with respect to one another and the members of the outer frame 20 may vary from one prior art sliding door model to the next.

With these modifications complete a conventional Horton Automatics ICU-type sliding door unit can be converted into a trackless unit according to the present sliding door 10, with the ability of the sliding panel 30 to break away or panic open at any point in the sliding panel's 30 travel. Also both panels 30, 40 may be broken away to facilitate moving large items through the sliding door 10. These modifications can easily be applied to any other conventional ICU sliding doors with the same result.

Those skilled in the art will readily appreciate that the sliding door 10 disclosed and claimed herein may be incorporated into alternate conventional sliding door units as well as implemented in OEM door units. Although the illustrative embodiments are directly mainly toward retrofitting a prior art Horton Automatics sliding door, the scope of the sliding door 10 is not so limited and applies to retrofitting other types/brands of prior art sliding doors in accordance with the present art sliding door 10 as well as producing a sliding door 10 with the capability of the sliding panel 30 to break away in any position and the sliding and fixed panels 30, 40 to both break away when the sliding panel 30 is fully or near fully open integrated into the sliding door 10 at initial production.

The materials used to construct the sliding door 10 and various elements thereof will vary depending on the specific application, but it is contemplated that metal, metallic alloys, glass, synthetic materials, glass, and/or combinations thereof will be especially useful for most applications. Accordingly, the above-referenced elements may be constructed of any material known to those skilled in the art or later developed, which material is appropriate for the specific application of the sliding door, without departing from the spirit and scope of the sliding door 10 as disclosed and claimed herein.

Having described the preferred embodiments, other features of the sliding door 10 will undoubtedly occur to those versed in the art, as will numerous modifications and alterations in the embodiments as illustrated herein, all of which may be achieved without departing from the spirit and scope of the sliding door 10. Accordingly, the methods and embodiments pictured and described herein are for illustrative purposes only.

It should be noted that the sliding door 10 is not limited to the specific embodiments pictured and described herein, but are intended to apply to all similar apparatuses and methods for producing a sliding door 10 or retrofitting a prior art sliding door such that the resulting sliding door 10 allows the sliding panel 30 to break away when the sliding panel 30 is in any position and allows both the sliding panel 30 and fixed panel 40 to break away when the sliding panel 30 is in the fully open position. Modifications and alterations from the described embodiments will occur to those skilled in the art without departure from the spirit and scope of the sliding door 10.

What is claimed is:

1. A sliding door comprising:

a. a header having first and second ends, wherein said header is secured to a top portion of an opening, wherein said header includes a sliding track along the length thereof, wherein said header includes a fixed panel guide along a portion thereof, and wherein said fixed panel guide is formed with a guide interlock extending therefrom;

b. a floor plate secured to a flooring surface below said header first end, wherein said floor plate further comprises a fixed panel post pivotally engaged with said fixed panel, and wherein said floor plate further comprises a panel bearing;

c. a fixed panel pivotally engaged with said header first end, wherein a fixed panel top rail is formed with a fixed panel interlock extending therefrom, and wherein said guide interlock and said fixed panel interlock cooperatively engage one another when said fixed panel is in a fixed panel first position;

d. a first lock member engaged with said fixed panel top rail, wherein said first lock member selectively engages said fixed panel guide such that in said fixed panel first position said fixed panel is secured in an orientation parallel with respect to said header, and such that in a fixed panel second position said fixed panel may pivot with respect to said header and said floor plate, and wherein said first lock member further comprises a guide detent formed in said fixed panel guide and a corresponding spring loaded ball placed in said fixed panel top rail;

e. a sliding panel cooperatively engaged with said header adjacent a sliding panel top rail such that said sliding panel may move linearly from said header first end to said header second end, wherein a sliding panel bottom rail is cooperatively engaged with a fixed panel bottom rail, and wherein said sliding panel may pivot with respect to said header and said fixed panel at any position between said header first and second ends;

f. a carrier bar having a portion thereof slidably mounted within said sliding track, and wherein said carrier bar includes a sliding panel pivot pin that pivotally engages said sliding panel top rail; and g. a second lock member engaged with a sliding panel top rail, wherein said lock member selectively engages said header such that in a sliding panel first position said sliding panel occupies a plane parallel to but offset from said fixed panel, and such that in a sliding panel second position said sliding panel may pivot with respect to said header and said fixed panel, wherein said second lock member further comprises a carrier bar detent formed in said carrier bar and a corresponding spring loaded ball placed in said sliding panel top rail, and wherein the periphery of said panel bearing is positioned to engage said sliding panel when both said fixed and sliding panel are in said second positions, respectively.

2. The sliding door according to claim 1 wherein said carrier bar further comprises a carrier bar interlock extending therefrom, wherein said sliding panel top rail further comprises a sliding panel interlock extending therefrom, and wherein said carrier bar interlock and said sliding panel interlock cooperatively engage one another when said sliding panel is in said sliding panel first position.

3. A sliding door comprising:

a. a header secured to a top portion of an opening, said header comprising:
   i. a first and a second end;
   ii. a sliding track extending along the length of said header;
   iii. a fixed panel guide extending along a portion of said header adjacent said header first end, wherein said fixed panel guide further comprises a guide interlock extending therefrom;
   iv. a fixed panel pivot pin extending downward from said header adjacent said header first end;

b. a floor plate secured to a flooring surface below said header first end, wherein said floor plate includes a fixed panel post extending upward from said flooring surface, wherein said floor plate further comprises a panel bearing, and wherein a longitudinal axis of said fixed panel post is the same as that of said fixed panel pivot pin;

c. a carrier bar slideably engaged with said sliding track, said carrier bar comprising:
   i. a first and a second end;
   ii. a sliding panel pivot pin extending downward from said carrier bar adjacent said carrier bar first end;
   iii. a carrier bar interlock extending therefrom;

d. a fixed panel pivotally engaged with said fixed panel pivot pin and said fixed panel post, said fixed panel comprising:
   i. a fixed panel first vertical rail having first and second ends, wherein said fixed panel first end is positioned adjacent said header first end;
   ii. a fixed panel top rail having first and second ends, wherein said fixed panel top rail first end is engaged with said fixed panel first vertical rail first end wherein said fixed panel top rail further comprises a fixed panel interlock extending therefrom;
   iii. a fixed panel bottom rail having first and second ends, wherein said fixed panel bottom rail first end is positioned adjacent said floor plate, and wherein a guide track extends from said fixed panel first end to said fixed panel second end;

e. a first lock member selectively engageable with said fixed panel top rail and said fixed panel guide, wherein said first lock member selectively engages said fixed panel guide such that in a fixed panel first position said fixed panel is secured in an orientation parallel to said header, and such that in a fixed panel second position said fixed panel may pivot about said fixed panel pivot pin and said fixed panel post, and wherein said guide interlock and said fixed panel interlock cooperatively engage one another in said fixed panel first position;

f. a sliding panel pivotally engaged with said carrier bar and said fixed panel, wherein said sliding panel may move with said carrier bar along the length of said sliding track, said sliding panel comprising:

i. a sliding panel first vertical rail having first and second ends, wherein said sliding panel first vertical rail first end is positioned adjacent said first end of said carrier bar;

ii. a sliding panel top rail having first and second ends, wherein said sliding panel top rail first end is engaged with said sliding panel first vertical rail first end;

iii. a sliding panel bottom rail having first and second ends, wherein said sliding panel bottom rail first end is positioned adjacent said floor plate when said carrier bar is positioned adjacent said header first end, and wherein said sliding panel slidably engages said guide track;

g. a second lock member selectively engageable with said top sliding panel top rail and said carrier bar, wherein said second lock member selectively engages said carrier bar such that in a first position said sliding panel occupies a plane parallel to but offset from said fixed panel, and such that in a second position said sliding panel may pivot with respect to said carrier bar and said fixed panel, wherein the periphery of said panel bearing is positioned to engage said sliding panel when both said fixed and sliding panel are in said second positions, respectively.

4. The sliding door according to claim 3 wherein said sliding door further comprises a guide block engaged with said sliding panel bottom rail adjacent said sliding panel bottom rail first end.

5. A method for providing selective access through an outer frame of the sliding door of claim 1 or 3 without the use of any floor track, said method comprising the steps:

a. outfitting said outer frame with a header adjacent the top portion of said outer frame, wherein said header include first and second ends, wherein said header is substantially linear and is formed with a sliding track and fixed panel guide therein;

b. securing a floor plate to a floor surface below said first end of said header;

c. pivotally engaging a fixed panel with said fixed panel guide and said floor plate;

d. providing a lock member between said outer frame and said fixed panel such that said fixed panel may be selectively secured in a first position with respect to said outer frame, wherein said fixed panel is substantially parallel with said header in said first position;

e. cooperatively engaging a sliding panel adjacent a sliding panel top rail with said header such that said sliding panel may move linearly along the length of said header;

f. cooperatively engaging said sliding panel adjacent a sliding panel bottom rail with said fixed panel to ensure that said sliding panel is straight and plumb with respect to said outer frame and said fixed panel when said sliding panel is moving along the length of said header, wherein said sliding panel is pivotal with respect to said header and said fixed panel;

g. providing a lock member between said header and said sliding panel such that said sliding panel may be selectively secured between said first and second ends of said header in a plane that is parallel to but offset from said fixed panel when said fixed panel is in said first position;

h. determining an amount of force that when applied to said sliding panel in a direction perpendicular to said header that will overcome said lock member between said sliding panel and said header that will cause said sliding panel to pivot with respect to said header regardless of the position of said sliding panel along the length of said header; and, i. determining an amount of force that when applied to said fixed panel in a direction perpendicular to said header that will overcome said lock member between said fixed panel and said outer frame that will cause said fixed panel to pivot with respect to said header when said sliding panel is positioned adjacent said header first end.

* * * * *